US006298841B1

(12) United States Patent
Cheng et al.

(10) Patent No.: US 6,298,841 B1
(45) Date of Patent: Oct. 9, 2001

(54) PAINTBALL GUN AND LIGHT EMITTING PROJECTILE-TYPE AMMUNITION FOR USE THEREWITH

(76) Inventors: Richard T. Cheng; James S. Cheng, both of 1536 Duke of Windsor Rd., Virginia Beach, VA (US) 23454

( * ) Notice: Subject to any disclaimer, the term of this patent is extended or adjusted under 35 U.S.C. 154(b) by 0 days.

(21) Appl. No.: 09/479,201

(22) Filed: Jan. 7, 2000

Related U.S. Application Data

(63) Continuation-in-part of application No. 08/907,137, filed on Aug. 6, 1997, now Pat. No. 6,082,349, which is a continuation of application No. 08/630,434, filed on Apr. 10, 1996, now abandoned, which is a continuation-in-part of application No. 08/491,711, filed on Jun. 19, 1995, now abandoned.

(51) Int. Cl.[7] ..... F41B 11/00
(52) U.S. Cl. ..... 124/56; 102/501
(58) Field of Search ..... 102/502, 573, 102/513; 273/58 H, 418; 124/56–80

(56) References Cited

U.S. PATENT DOCUMENTS

| | | | | |
|---|---|---|---|---|
| 3,240,924 | | 3/1966 | Darby . | |
| 3,445,551 | | 5/1969 | Griffin . | |
| 3,822,393 | | 7/1974 | Karpol . | |
| 4,175,353 | | 11/1979 | Pickett . | |
| 4,239,129 | | 12/1980 | Esposito . | |
| 4,552,365 | * | 11/1985 | Smith | 273/425 |
| 4,634,606 | | 1/1987 | Skogg . | |
| 4,855,191 | | 8/1989 | Arakawa et al. . | |
| 4,927,015 | | 5/1990 | Jones . | |
| 4,930,776 | | 6/1990 | Newcomb et al. . | |
| 5,001,880 | * | 3/1991 | Smith | 53/453 |
| 5,009,165 | * | 4/1991 | Morris | 102/513 |
| 5,018,450 | | 5/1991 | Smith . | |
| 5,035,183 | * | 7/1991 | Luxton | 102/502 |
| 5,080,359 | | 1/1992 | Thill . | |
| 5,228,697 | | 7/1993 | Gulick et al. . | |
| 5,254,379 | | 10/1993 | Kotsiopoulos et al. . | |
| 5,276,075 | | 1/1994 | Santini . | |
| 5,287,134 | | 2/1994 | Cocca . | |
| 5,308,546 | | 5/1994 | Hansen et al. . | |
| 5,393,054 | | 2/1995 | Rouffer . | |
| 5,415,151 | | 5/1995 | Fusi et al. . | |
| 5,448,951 | | 9/1995 | Olson . | |
| 5,498,280 | | 3/1996 | Fistner et al. . | |
| 6,082,349 | * | 7/2000 | Cheng et al. | 124/56 |

FOREIGN PATENT DOCUMENTS

| | | |
|---|---|---|
| 1 268 635 | 3/1972 | (GB) . |

* cited by examiner

*Primary Examiner*—Charles T. Jordan
*Assistant Examiner*—Kevin Jakel
(74) *Attorney, Agent, or Firm*—MacMillian, Sobanski & Todd, LLC

(57) ABSTRACT

Light emitting rigid fracturable projectile-type marking ammunition are provided. The ammunition is a phosphorescent ball in the form of a spherical pellet or capsule that includes non-phosphorescent impact diffusing materials intimately admixed with phosphorescent materials. Non-phosphorescent pigments, fillers, and surfactants may also be included. The light emitting phosphorescent ball provides a luminous trail when discharged from the paintball gun and thus, may be used effectively in the dark.

32 Claims, 11 Drawing Sheets

PAINTBALL GUN AND LIGHT EMITTING PROJECTILE-TYPE AMMUNITION FOR USE THEREWITH

This is a continuation-in part of application Ser. No. 08/907,137, filed Aug. 6, 1997, now U.S. Pat. No. 6,082,349 which is a continuation of application Ser. No. 08/630,434, filed on Apr. 10, 1996, now abandoned which is a continuation-in-part of application Ser. No. 08/491,711, filed on Jun. 19, 1995, now abandoned.

BACKGROUND OF THE INVENTION

The present invention relates generally a paintball gun and to light emitting ammunition, including fracturable projectile-type marking ammunition, and more specifically, to phosphorescent balls, such as paintballs, which provide a luminous trail when discharged from a paintball gun.

Exercises or recreational activities involving paintball guns have become quite popular. Participants arranged in teams shoot paintballs at targeted participants of opposing teams. When a paintball strikes a targeted participant, it fractures and splatters a filler material, marking the targeted participant. The marked participant is disqualified from further participation in the exercise or activity.

Paintball guns known in the prior art are effective only when used in adequate lighting. In adequate lighting, a user can easily observe the impact of a paintball, and possibly the trace of its path, and adjust his aim accordingly. This does not hold true, however, when used in the dark because the user cannot trace the path of the paintball and hence, cannot determine with any amount of accuracy whether a targeted participant has been hit.

A paintball gun capable of discharging luminous paintballs overcomes the foregoing disadvantage of known paintball guns. Paintball pellets capable of emitting light would provide a luminous tail.

None of the paintball guns known in the prior art, taken either singly or in combination, are seen to describe the instant invention as claimed.

SUMMARY OF THE INVENTION

The present invention is drawn generally to phosphorescent balls, having energy dispersing characteristics on impact with a target, for use with air-powered paintball guns. These phosphorescent balls include fracturable paintballs. More particularly, the instant invention is a phosphorescent ball for use with an exciter for exciting the ball to emit light and thus, provide a luminous trail when discharged from a paintball gun.

A phosphorescent ball according to the instant invention comprises a spherical pellet or capsule. The pellet or capsule may define an interior chamber with a fluid filler contained in the chamber. The capsule or pellet supports a phosphorescent material. The phosphorescent material may be supported by distributing the phosphorescent material in a fluid portion of the pellet or capsule. Accordingly, the phosphorescent material is intimately combined with non-phosphorescent pellet materials. The phosphorescent material absorbs light when exposed to a light source, and after the light source is removed, emits light.

The phosphorescent balls of the present invention are designed to be launched from air-powered guns, such as paintball guns, and have energy dispersing characteristics upon impact with a target. Energy may be dispersed from the phosphorescent balls in the same manner as conventional paintballs, that is, by fracturing the phosphorescent balls. Fracturable paintballs according to the present invention may include non-phosphorescent pigment material in combination with the phosphorescent material.

A phosphorescent ball being discharged from a paintball gun enters an exciter. Upon detecting the presence of a phosphorescent ball, the exciter is triggered to produce a substantially instantaneous, high intensity light. Light is absorbed by the phosphorescent material. After the light is removed, the phosphorescent material continues to emit light. Fracturable paintballs according to the instant invention, when discharged through the exciter, provide a luminous trail. The paintball gun, which may be provided in combination with the exciter and/or phosphorescent balls, includes a muzzle and a launching mechanism for sending a phosphorescent ball through the muzzle. Alternatively, the exciter and paintball gun may be unitarily made.

The present invention is also drawn to a paintball gun for discharging phosphorescent balls. The paintball gun has an exciter coupled thereto which is adapted to excite a phosphorescent ball so that the phosphorescent ball emits light and provides a luminous trail when discharged from said paintball gun.

Accordingly, it is a principal object of the invention to provide fracturable balls, such as paintballs, which provide a luminous trail when discharged from a paintball gun.

It is another object to provide a ball which emits light when exposed to, and subsequently removed from, a light source.

Another object is to provide a ball, such as a paintball, comprising a phosphorescent material or some other photon absorbing and emitting material.

It is yet another object to provide phosphorescent balls which emit different color light and thus, provide different color trails when discharged from a paintball gun.

It is a further object to provide a phosphorescent ball which emits a luminous trail when discharged from a paintball gun and, upon impact, fractures to splatter a luminous filler or paint therefrom.

Another object of the present invention is to provide an exciter together with fracturable balls; the exciter for exciting phosphorescent balls carrying photon absorbing and emitting material so as to emit light and thus provide a luminous trail when discharged from a paintball gun.

It is yet another object that the exciter be adapted to couple to a variety of paintball gun muzzles.

It is still another object of the present invention to provide a paintball gun including the exciter, and phosphorescent balls for use therewith.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
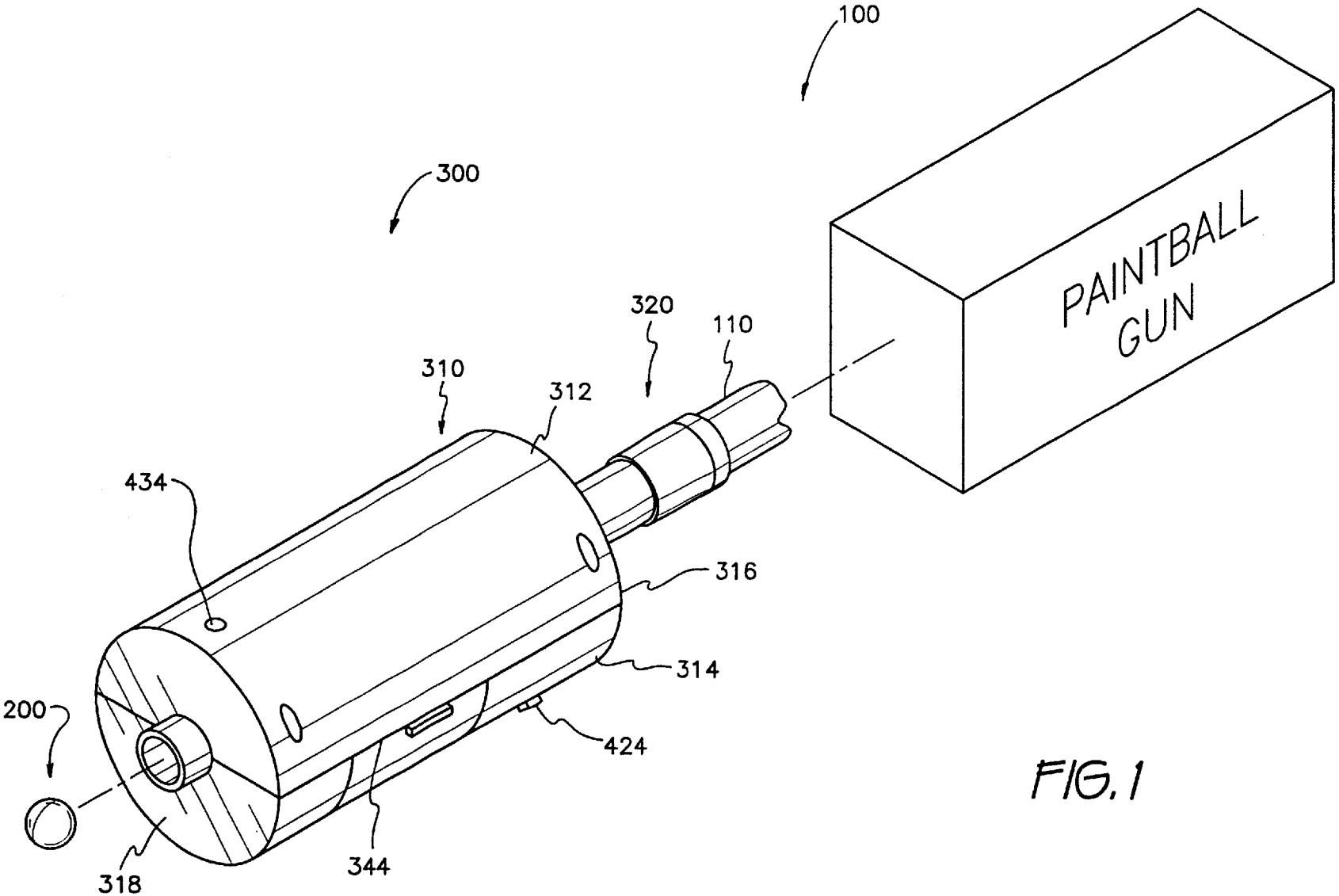
FIG. 1 is a partial perspective view and partial block diagram respectively showing a phosphorescent ball and an exciter according to the instant invention, and a paintball gun used in combination therewith.

Now, with reference to the drawings, FIG. 1 shows a paintball gun 100 adaptable for use in discharging light emitting phosphorescent ball projectiles 200, and more particularly, a phosphorescent ball 200 and an exciter 300 for use in combination with a paintball gun 100. The exciter 300 excites the phosphorescent ball 200 to emit light and provide a luminous trail when discharged from a paintball gun 100. The travel of a phosphorescent ball 200 may be traced in a dark or poorly lit environment.

An exciter 300 is shown coupled to the muzzle 110 of a paintball gun 100. The exciter 300 comprises a cylindrical housing 310 formed of diametrically disposed halves 312 and 314. The housing 310 has a proximal end 316 and a distal end 318. An adapter 320 extending from the proximal end 316 of the housing 310 is configured to couple the exciter 300 to the muzzle 110 of the paintball gun 100.

Upon discharging a phosphorescent ball 200 from the paintball gun 100, the phosphorescent ball 200 exits through the muzzle 110 of the paintball gun 100, and then passes through the exciter 300 coupled to the muzzle 110. As the phosphorescent ball 200 passes through the exciter 300, the phosphorescent ball 200 is excited to emit light. The light emitting phosphorescent ball 200 exiting the exciter 300 provides a luminous trail which permits the path of the phosphorescent ball 200 to be traced.

Figure 2:
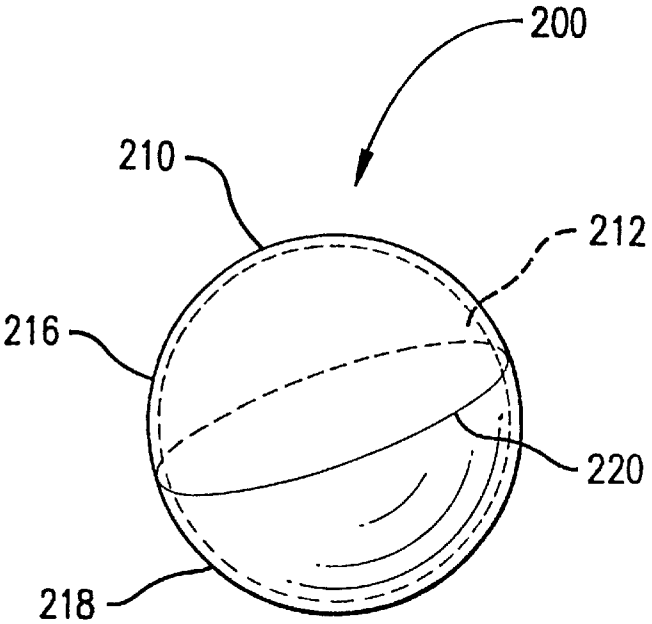
FIG. 2 is a perspective view of a phosphorescent ball according to the instant invention.

A phosphorescent ball may include a pellet or capsule defining a spherical periphery, containing a diverse filler, such as the phosphorescent ball 200 shown in FIG. 2. This phosphorescent ball 200 comprises a spherical capsule 210 defining an interior chamber 212, and a filler (such as the filler in FIGS. 3 and 4) contained within the interior chamber 212. Typical capsules are approximately 1.496 centimeters (cm) in diameter.

The capsule 210 is formed of two half spheres 216 and 218. These hemispheres 216 and 218 are fused together along a sealing area defined by the adjoining hemisphere edges, thus providing a fusion band 220. As the hemispheres 216 and 218 are fused together, the filler is injected into the capsule 210 as it is being sealed. The capsule 210 is formed of a material impervious to the filler, and is of a thickness suitable to support the filler and withstand discharge, yet fracture upon impact. It is preferable that the thickness of the capsule 210 according to the instant invention ranges from 0.7 to 1.2 millimeters (mm).

It is preferable that the filler be washable. Moreover, the filler is preferably not injurious to a targeted participant (not shown). Furthermore, the filler is preferably biodegradable and safe to the environment.

Figure 3:
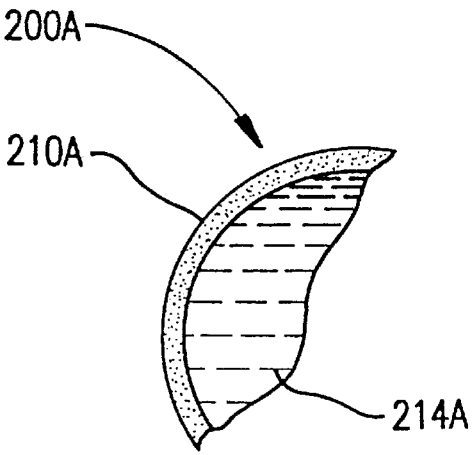
FIG. 3 is a partial section view of one embodiment of a phosphorescent ball according to the instant invention.

FIG. 3 shows a phosphorescent ball 200A comprising a capsule 210A impregnated with phosphorescent material. The capsule 210A preferably comprises 90–95 percent gelatin with 5–10 percent zinc sulfide (ZnS) doped with some photon absorbing or emitting material, such as copper ($Cu^{++}$) ($ZnS,Cu^{++}$). The gelatin is preferably substantially transparent or translucent to permit maximum exposure of the phosphorescent material to incident radiation. Moreover, it is preferable that the thickness of this capsule 210A ranges between 0.8 to 1.2 millimeters (mm) to sufficiently excite the phosphorescent material. The thickness of the capsule 210A is also critical to provide sufficient structural integrity to withstand discharge without fracturing, yet fracture easily upon impact to splatter the filler 214A while causing minimum impact sting to a targeted participant (not shown). A transparent glycerin filler 214A is provided in this embodiment.

Figure 4:
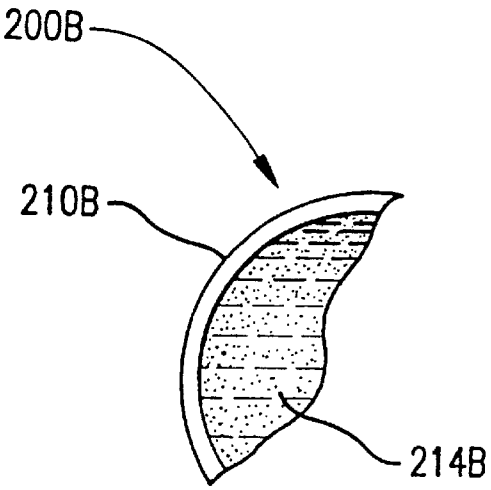
FIG. 4 is a partial section view of another embodiment of a phosphorescent ball according to the instant invention.

An alternative phosphorescent ball 200B is shown in FIG. 4. This embodiment is provided with a substantially transparent or translucent capsule 210B. Although the capsule 210B may be formed of any material sufficiently rigid to support a filler or solvent (and more particularly a dispersing medium) 214B and withstand discharge yet be frangible upon impact, a gelatin capsule is preferred. In this embodiment, it is preferable that the capsule 210B have a thickness ranging from 0.7 to 0.9 millimeters (mm). The filler 214B in this embodiment is mixed with a surfactant (such as a commercial surface active agent) or dispersing agent and a phosphorescent material. Although the filler 214B preferably comprises a member of an organic group consisting of compounds referred to as triols, and in this case transparent glycerin or glycol, an alkyltriol, any solvent or family of solvents with properties of being insolvent with, and permitting the dispersing agent to disperse, the phosphorescent material will suffice. The phosphorescent material is preferably comprised of 2–6 percent zinc sulfide (ZnS) doped with copper ($Cu^{++}$) ($ZnS,Cu^{++}$). Surfactants for use with $ZnS,Cu^{++}$ to obtain stable suspension include:

ALKATERGE T and ALKATERGE T-IV, oxazoline-type nonvolatile surface active agents that include heptadecenyl and oxazoledimethanol mixtures which are available from BECCO; ZELEK NK ANTISTAT, a fatty alcohol phosphate available from DuPONT; TWEEN 20, polyoxyethylene-sorbitane-monolaurate available from ICI AMERICAS; and TWEEN 80, polyoxyethylene-sorbitane-monooleate available from ICI AMERICAS. To obtain best results, a ratio of 6:4 of surfactant to $ZnS,Cu^{++}$ by weight should be used.

In use, exposure of either phosphorescent ball 200A or 200B to light excites the phosphorescent material to emit light. The phosphorescent material is best excited by ultraviolet rich light, and black light is twice as effective as incandescent light.

Light emitting phosphorescent balls 200A or 200B provide a luminous trail when discharged. The color of the trail varies in accordance with the composition of the phosphorescent ball 200A or 200B. Various basic materials may be doped with various activators to emit different color lights. Basic materials include, but are not limited to zinc sulfide ZnS, calcium sulfide CaS, strontium sulfide SrS, and mixtures thereof, such as calcium and strontium sulfide (Ca,Sr)S. Activators may include, but are not limited to, copper Cu, manganese Mn, and bismuth Bi. Zinc sulfide ZnS doped with copper Cu ($ZnS,Cu^{++}$), as set forth above, emits a green trail. Zinc sulfide ZnS doped with copper Cu and manganese Mn (ZnS(Cu,Mn)) emits a yellow or orange trail. Calcium and strontium sulfide (Ca,Sr)S doped with bismuth Bi ((Ca,Sr)S,Bi) emits a blue trail.

Figure 16:
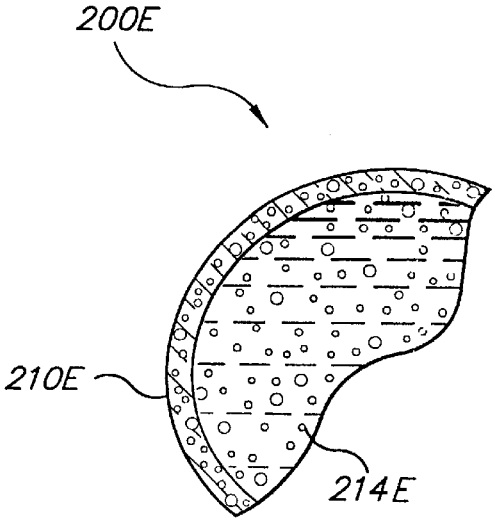
FIG. 16 is a partial section view of another embodiment of a phosphorescent ball according to the instant invention.

As can be deduced from the above, both capsule 210E and filler 214E may include phosphorescent material, as shown by phosphorescent ball 200E in FIG. 16. The phosphorescent material used in the capsule 210E may be the same or different from that used in the filler 214E. When different phosphorescent materials are used, various color combinations can be produced upon excitation.

Figure 14:
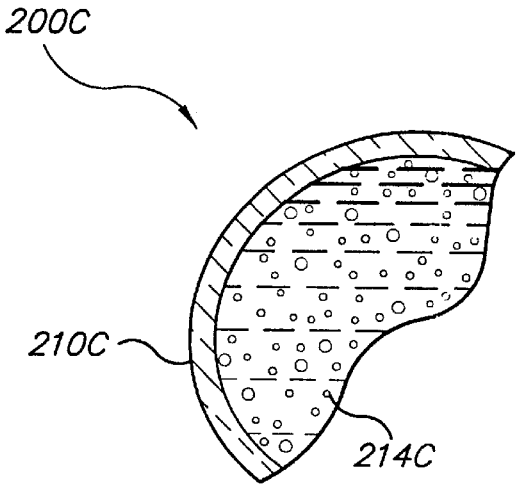
FIG. 14 is a partial section view of another embodiment of a phosphorescent ball according to the instant invention.

Further, non-phosphorescent pigment material may be used in combination with the phosphorescent material in the filler 214C, as shown in FIG. 14, in the capsule 210C, or in both the filler 214C and capsule 210C. Preferably, a small percentage of color pigment is added to the filler in an amount up to one percent by weight. More preferably, from about 0.05 to about 0.5 percent by weight of the non-phosphorescent pigment is used. Most preferably, the non-phosphorescent pigment is substantially biodegradable, water soluble, washable, and non-toxic.

When present in the filler, non-phosphorescent pigment material may be selected from any used in standard paintballs, and may be used to identify the shooter in a paintball game. Each individual or team may be supplied with phosphorescent balls containing distinctive non-phosphorescent materials from other individuals or teams, for identifying the source of hits. When used in lower amounts, phosphorescent balls with different non-phosphorescent pigments may be indistinguishable from each other in flight, but are clearly distinguishable on the target.

If desired, sufficient non-phosphorescent pigment may be used to visualize color trails in flight such that the phosphorescent materials illuminate the non-phosphorescent pigment materials. This may be accomplished when the non-phosphorescent pigment is provided at greater than about 0.2 percent by weight. To minimize any decrease in phosphorescent brilliance, no more than about one percent by weight of non-phosphorescent pigment is preferred.

While the above embodiments are directed at mainly fracturable marking ammunition such as paintballs, the present invention also includes reusable phosphorescent balls. In some recreational facilities, such as on military bases, amusement parks, and carnivals, it may become difficult or cost prohibitive to clean an area of paint and gel fragments after target shooting using paintballs. To allow these facilities to still provide nighttime contests, a reusable phosphorescent ball is provided.

Figure 17:
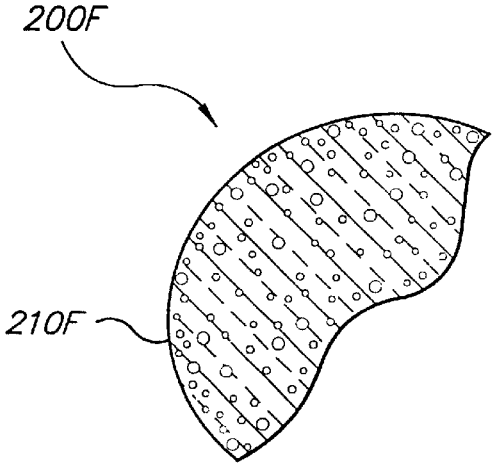
FIG. 17 is a perspective view showing an assembly of a paintball gun, exciter, and phosphorescent ball according to the present invention.

FIG. 17 shows a solid, resilient phosphorescent ball 200F made of soft pellet materials 210F such that the impact felt by a player will not be any greater than that felt from a frangible paintball. These soft pellet materials also must withstand launching from standard paintball guns to allow existing equipment to be used with the present invention; the existing equipment may be easily and reversibly modified with the exciter of the present invention, described below. Further, phosphorescent material is integrally dispersed through the soft pellet material. Therefore, light from the exciter must penetrate, and emitted light from the phosphorescent material must be clearly displayed, through the periphery of the resilient phosphorescent ball.

A number of chemical products may be used to provide the soft materials, so long as they meet the requirements for light transmission, resiliency, and impact absorption. The urethane and silicone rubber families of compounds and polymers meet these requirements, and are preferably used as the soft pellet materials. Advantageously, the degree of hardness of both these materials may be controlled by varying the mixing ratios of their respective curing components. Phosphorescent material is also added, preferably in an amount from about 0.5 percent to about 1.5 percent by weight of the pellet materials. Most preferably, at least one percent by weight of the phosphorescent material is used. The soft pellet materials with phosphorescent material dispersed therein are then injected in a mold and cured to form the reusable phosphorescent balls.

Alternative materials including foams and foam rubbers may also be used, so long as they provide the required light transmission, resiliency, and impact absorption characteristics described. Foams and foam rubbers may be admixed with the phosphorescent materials and cured. A mold may be used for curing the foam and foam rubbers into a final spherical shape, or a foam mass formed by curing may be shaped. It is stressed however, that the phosphorescent material used should be dispersed throughout the pellet material, and not coated thereon. Since the soft pellet material is of a resilient, energy absorbing nature, coated materials would tend to delaminate, chip, or otherwise be exposed to damage.

Figure 15:
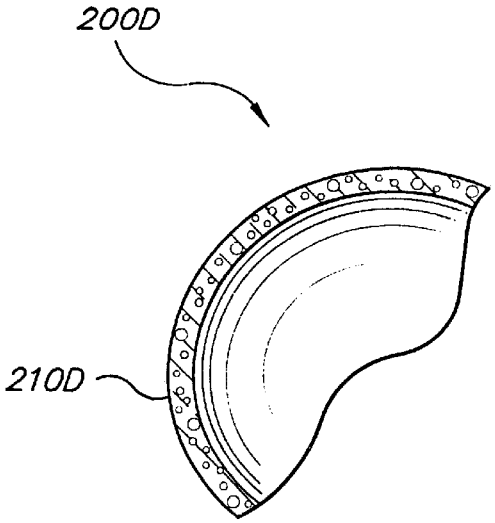
FIG. 15 is a partial section view of a phosphorescent ball according to the instant invention.

FIG. 15 shows a reusable, resilient phosphorescent ball having a capsule 210D and a hollow core. In such an arrangement, air contained within the ball may be used to absorb additional impact energy. Therefore, the hardness of the pellet material may be increased over the solid embodiment of FIG. 17, so long as the overall phosphorescent ball pellet, including the air enclosed by the pellet material, has sufficient impact energy diffusing character to provide substantially non-injurious use. As with the solid reusable phosphorescent balls, phosphorescent material is intimately incorporated with the pellet material. Mold curing of an admixture of the phosphorescent material and the pellet material components may be used. In either of the reusable phosphorescent balls, non-phosphorescent pigment materials may be used to identify the shooter of the phosphorescent ball, and/or for modifying the apparent color emitted, substantially as described for the fracturable phosphorescent balls described above.

Any of the phosphorescent balls of the present invention may be provided in kit form with a matched exciter. This insures optimum excitation at the correct wavelengths to produce the desired re-emitted illumination level and/or time. With regard to the exciter, all the phosphorescent balls will be referred to as phosphorescent ball 200, but is understood to include the embodiments of 200A, 200B, 200C, 200D, 200E, and 200F.

Figure 6:
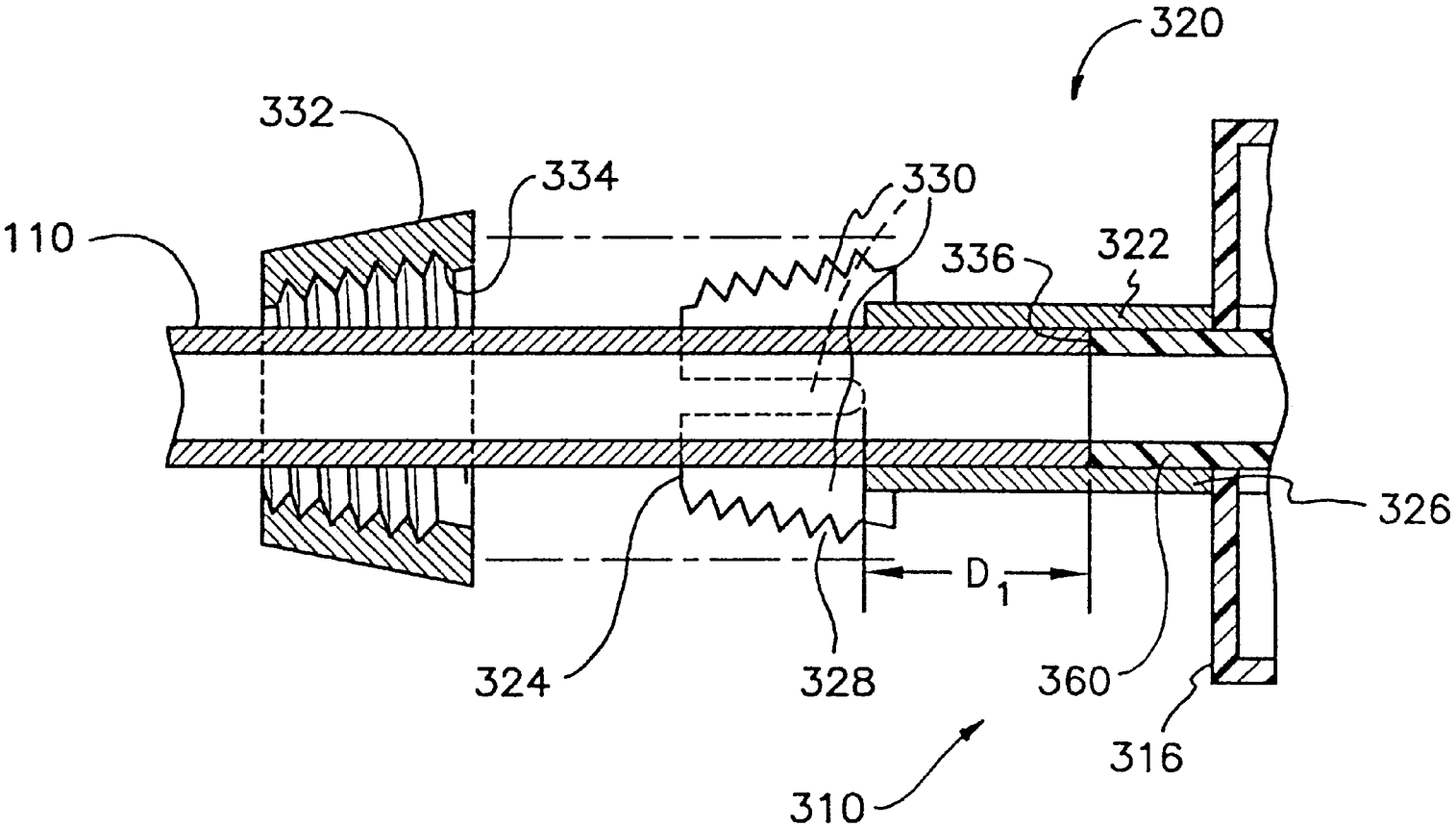
FIG. 6 is a section view of an adapter for coupling the exciter to the muzzle of a paintball gun.

Referring back to FIG. 1, an exciter 300 for exciting phosphorescent balls is shown comprising a cylindrical housing 310 having diametrically disposed half sections 312, 314, a proximal end 316, and a distal end 318. An adapter 320 extends from the proximal end 316 of the housing 310. The adapter 320 is configured to couple the exciter 300 to the muzzle 110 of a paintball gun 100. As shown in FIG. 6, the adapter 320 comprises a tubular member 322 having a proximal end 324 and a distal end 326 respectively defining the proximal end and distal end of the adapter 320. The distal end 326 of the tubular member 322 is adjoined concentrically to the proximal end 316 of the housing 310, such as, for example, through some adhesion, fusion, or molding process. The proximal end 324 of the tubular member 322 is provided with tapered male threads 328, and has a plurality of longitudinal slits 330 therein extending substantially perpendicular to the tapered male threads 328.

A collar 332 having female threads 334 is matingly engageable with the beveled male threads 328 of the tubular member 322. As the collar 332 threadably engages the tubular member 322, the slits 330 are drawn closed. As the slits 330 are drawn closed, the proximal end 324 of the tubular member 322 frictionally engages the muzzle 110 of a paintball gun 100. Although a plurality of slits 330 produce greater frictional contact, a single slit 330 may suffice.

As is clearly shown in the drawing, a concentric inner abutment surface 336 is provided within the tubular member 322. This abutment surface 336 limits the travel of the muzzle 110 within the tubular member 322 yet enables the muzzle 110 to extend a predetermined distance $D_1$ beyond the slits 330 to provide a substantially enclosed junction at the juncture of the adapter 320 and muzzle 110.

Referring back to FIG. 1, the exciter 300 further includes a switch 424, such as the toggle switch shown. The switch 424 enables and disables the exciter circuit 400 (shown in FIG. 8 and described hereinbelow). A neon indicator 434 is located on top of the housing 310 and at the distal end 318 of the housing 310. The neon indicator 434 is electrically connected to the switch 424 and illuminates when the switch 424 is closed, providing the user with an indication that the exciter circuit 400 is enabled.

Figure 5:
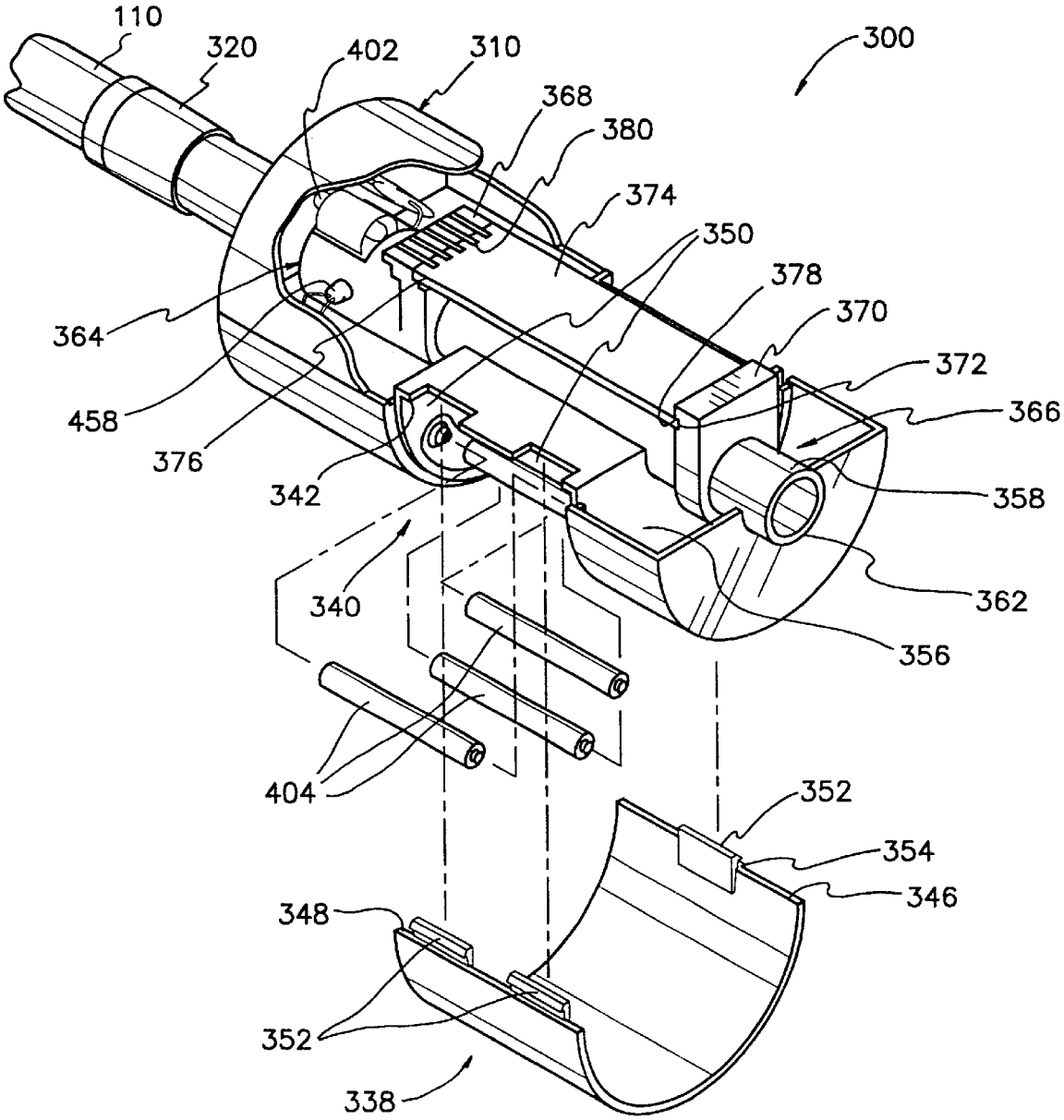
FIG. 5 is a partially exploded, partially cutaway perspective view of an exciter according to the instant invention.

Referring also to FIG. 5, the exciter 300 also comprises an arcuate shaped cover 338 which is structured and configured to conform substantially flush with, and define in part, the cylindrical housing 310. The cover 338 releasably engages the housing 310 and forms an access cover for a battery compartnent 340 which is provided to contain a low voltage power source 404, such as the plurality of 1.5 VDC batteries shown. The power source 404 energizes the exciter circuit 400 when the switch 424 is closed.

As shown in the drawings, the housing 310 includes opposite sides 342 and 344. Similarly, the cover 338 includes opposite side edges 346 and 348. These side edges 346 and 348 correspond to the opposite sides 344 and 342 of the housing 310. The side edges 346 and 348 of the cover 338 abut the sides 344 and 342 of the housing 310 when the cover 338 engages the housing 310.

Openings 350 are formed along the sides 342 (not shown in one side 344) of the housing 310. Hooks 352 extending upwardly from the side edges 346 and 348 of the cover 338 are structured and configured to engage corresponding openings 350 along respective sides 344 and 342 of the housing 310. The arcuate structure of the cover 338 normally biases the hooks 352 outward within the corresponding openings 350 to engage the hooks 352 with the structure of the housing 310 forming the openings 350, thus latching the cover 338 to the housing 310. To unlatch the cover 338 from the housing 310, simply depress one or both sides of the cover 338 inward. This displaces the hooks 352 inward out of contact with the structure of the housing 310 forming the openings 350, and thus permits the cover 338 to be separated from the housing 310.

A nodule 354 is provided along one side 346 of the cover 338 proximate a hook 352 to assist the user in identifying the location of the hook 352 when the cover 338 is attached to the housing 310. Moreover, indicia, such as the term "Open", may be inscribed on the cover 338 proximate the nodule 354 to assist the user in identifing the function of the nodule 354.

Now, referring only to FIG. 5, the housing 310 of the exciter 300 defines an interior chamber 356. The interior chamber 356 contains the exciter circuit 400 (shown clearly in FIGS. 8 and 9) and has a tube 358 passing concentrically therethrough. The tube 358 has a proximal end 360 (shown in FIG. 6) and a distal end 362, and is at least partially transparent to permit light to pass therethrough. The proximal end 360 of the tube 358 is preferably attached to the proximal end 316 of the housing 310, and the distal end 362 of the tube 358 is preferably attached to the distal end 318 of the housing 310, thus maintaining the tube 358 in a fixed position within the chamber 356.

The tube 358 has a head 364 attached to its proximal end 360 and a support member 366 attached to its distal end 362. The head 364 comprises a six pin female connector 368, and supports an infrared light emitting diode 456 (shown in FIG. 8), a photo transistor 458, and a pair of diametrically disposed flash bulbs or tubes 402 (the second of which is clearly shown in FIGS. 9 through 12) in close proximity to the tube 358. The support member 366 includes an upper extension 370 having a lateral groove 372 therein.

A circuit board 374 extending longitudinally within the chamber 356 has a proximal end 376 and a distal end 378. A six pin male connector 380 is integral with the proximal end 376 of the circuit board 374. This connector 380 is matingly engageable with the female connector 368 on the head 364 and thus, supports the proximal end 376 of the circuit board 374. The distal end 378 of the circuit board 374 is frictionally engageable with the lateral groove 372 in the support member 366. This supports the distal end 378 of the circuit board 374.

Figure 8:
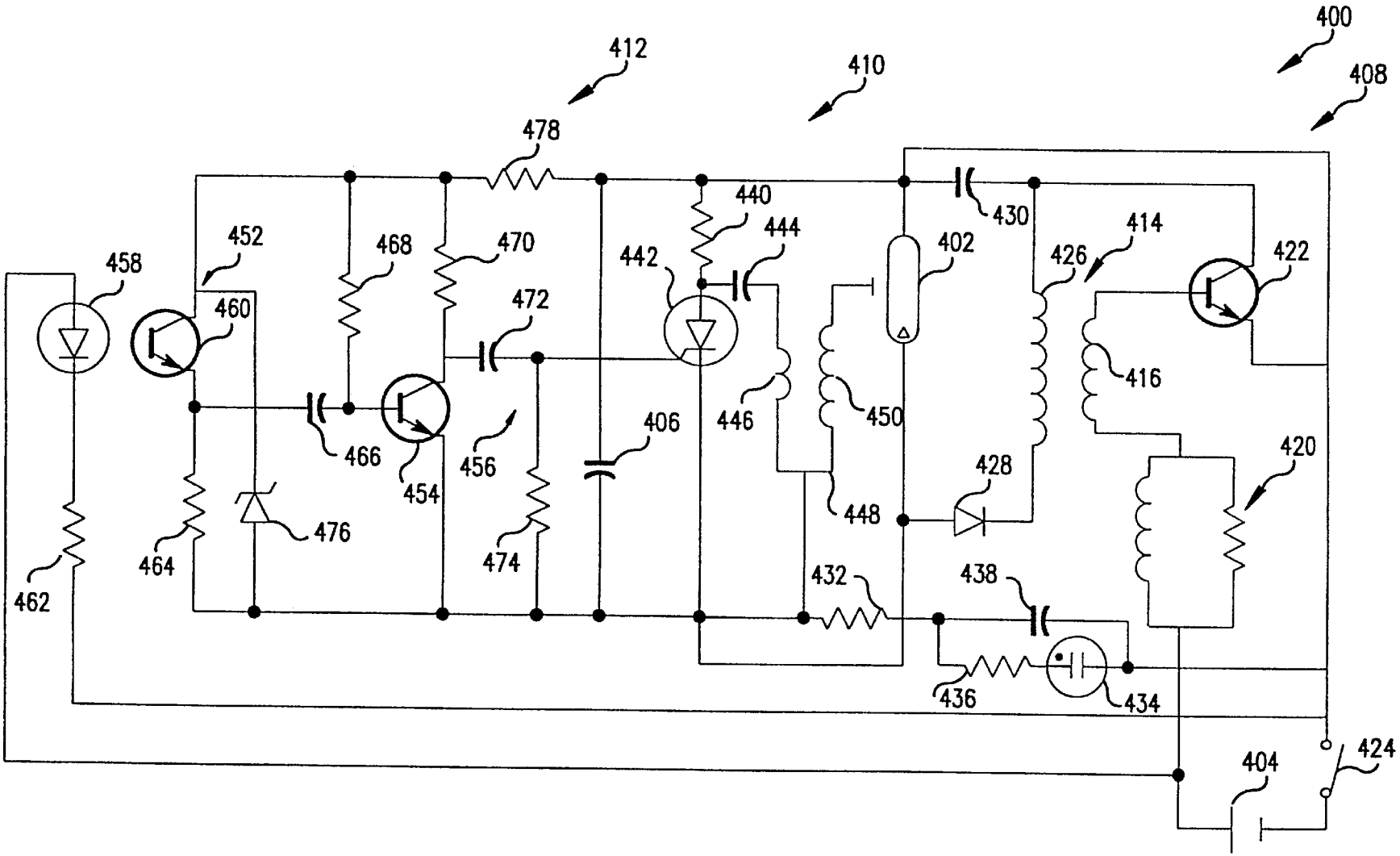
FIG. 8 is a schematic representation of an exciter electrical circuit.
Figure 9:
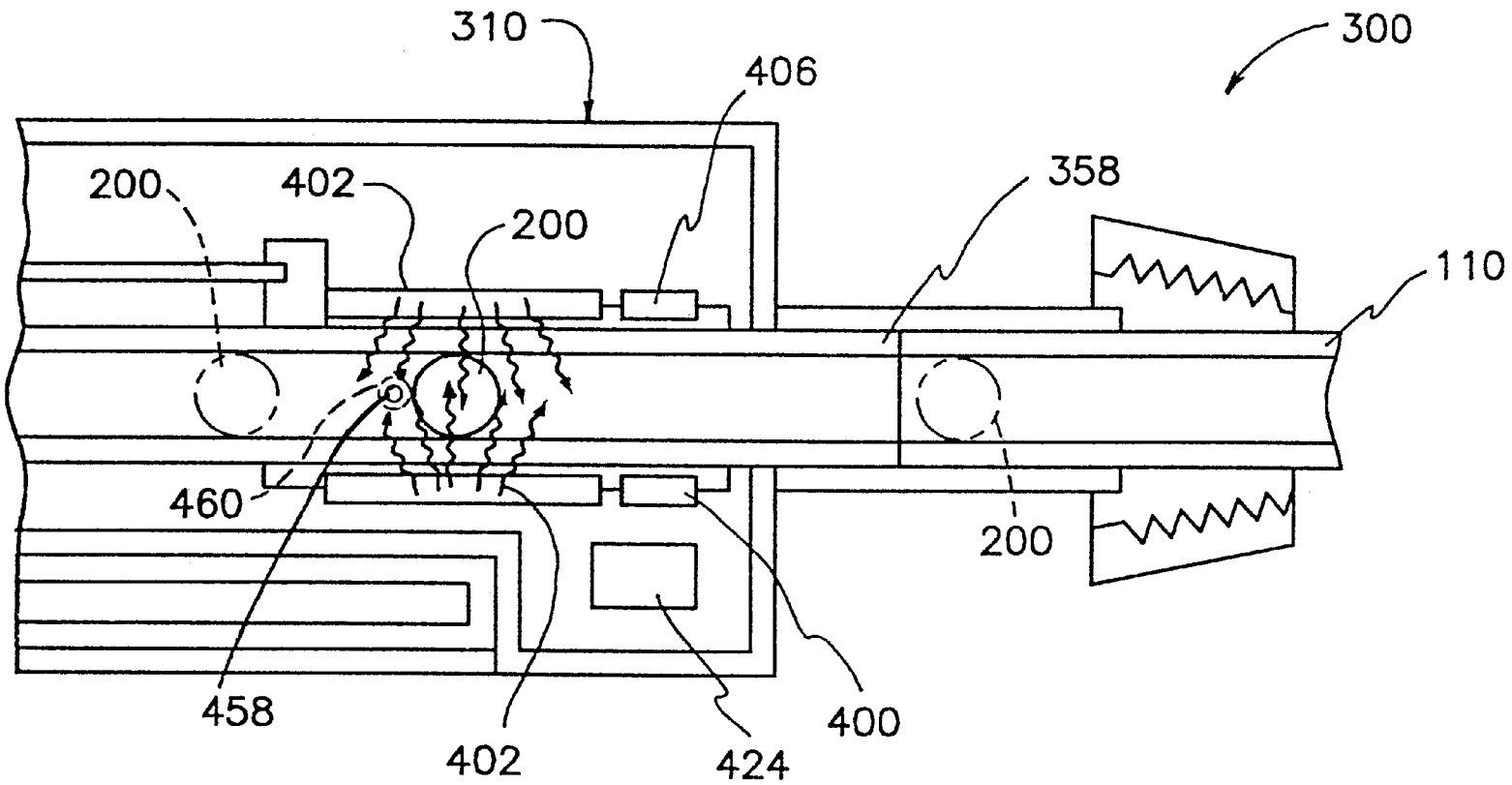
FIG. 9 is a diagrammatic representation of a phosphorescent ball being discharged through the exciter.
Figure 10:
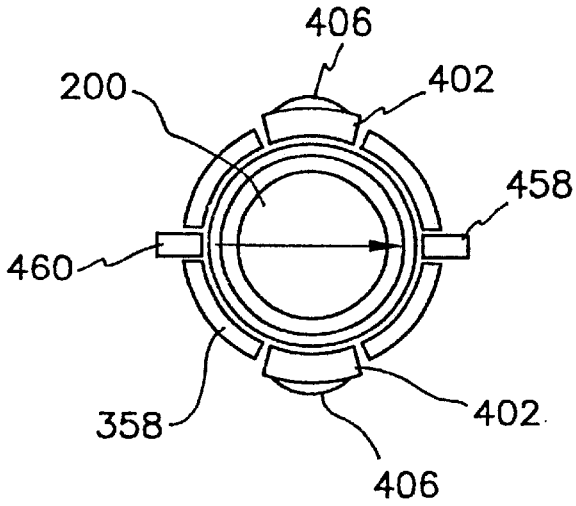
FIG. 10 is a diagrammatic representation of a phosphorescent ball approaching the emitter-detector pair.
Figure 11:
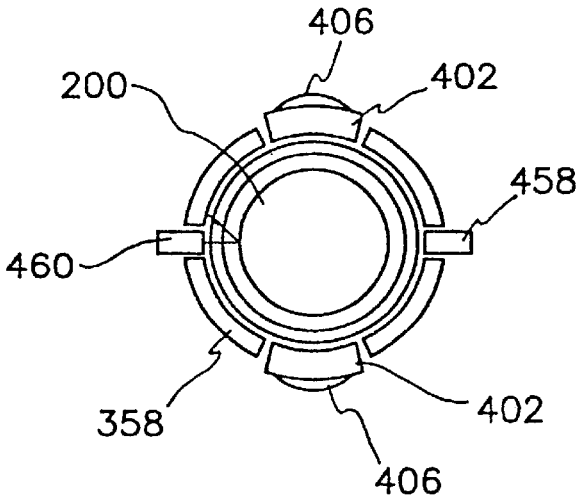
FIG. 11 is a diagrammatic representation of a phosphorescent ball interrupting an infrared beam emitted from the infrared light emitting diode of the emitter-detector pair.
Figure 12:
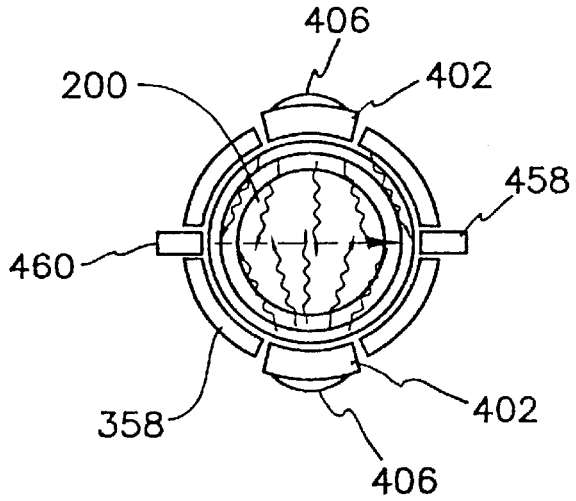
FIG. 12 is a diagrammatic representation of a phosphorescent ball absorbing light from the strobe flash bulbs or tubes subsequent to the photo transistor of the emitter-detector pair detecting an interruption in light emitted from the infrared light emitting diode.

With reference to FIGS. 8 and 9, an exciter circuit 400 includes a pair of energizable flash tubes 402 arranged to project light in a direction interiorly of the exciter tube 358 (as is shown in FIGS. 10 through 12), a low voltage power source 404 for providing charging energy, a high voltage storage element or capacitor 406 coupled to the flash tubes 402, a high voltage generator circuit 408 for providing charging current from the power source 404 to the high voltage capacitor 406 until the capacitor 406 is charged to a predetermined voltage, a trigger circuit 410 for generating a trigger voltage to set off the flash tubes 402, and a detector circuit 412 for controlling the trigger circuit 410.

A high voltage generator circuit 408 similar to that of the instant invention is set forth in U.S. Pat. No. 3,822,393, issued Jul. 2, 1974 to Zvi Y. Karpol. The high voltage generator circuit 408 comprises a step up transformer 414 having one terminal of its primary winding 416 coupled to the positive side of the low voltage power source 404 through an RL network 420, and the other terminal of its secondary winding 426 is coupled to the base of an oscillator transistor 422. The emitter of the oscillator transistor 422 is connected to the negative side of the power source 404 through a switch 424. The collector of the oscillator transistor 422 is connected to one terminal of the secondary winding 426 of the step up transformer 414, and of which the other terminal is coupled to the cathode of the flash tube 402 through a rectifier diode 428. A high frequency coupling capacitor 430 has one terminal connected to the junction of the terminal of the secondary winding 426 and the collector of the oscillator transistor 422, and the other terminal connected to a terminal of the high voltage capacitor 406. The other terminal of the high voltage capacitor 406 is connected to the junction of the emitter of the oscillator transistor 422 and switch 424 through a bleeder resistor 432, a neon indicator 434 and current limiting resistor 436, and a filter capacitor 438. The high voltage generator 408 converts the 1.5 VDC power source 404 to approximately 250 VDC, which is stored in the high voltage capacitor 406.

The trigger circuit 410 for discharging the high voltage capacitor 406 is similar to that shown and described in U.S. Pat. No. 5,287,134, issued Feb. 15, 1994 to J. David Cocca. The trigger circuit 410 includes the series combination of a resistor 440 and a discharge trigger SCR 442 connected across the high voltage capacitor 406. The junction between the resistor 440 and the anode of the discharge trigger SCR 442 is connected to one terminal of a coupling capacitor 444, the other terminal of which is connected to one end of the primary winding 446 of a trigger transformer 448. The other terminal of the primary winding 446 of the trigger transformer 448 is connected to the cathode of the discharge trigger SCR 442. The secondary winding 450 of the trigger transformer 448 is connected to the gate of the flash tube 402. The anode terminal of the flash tube 402 is connected to the junction of the resistor 440 connected to the anode of the discharge trigger SCR 442 and the high voltage capacitor 406, and the cathode of flash tube 402 is connected to the cathode of the discharge trigger SCR 442 at the junction of the rectifier diode 428. The flash tube 402 is triggered into conduction by a 3000 VDC signal produced by the trigger transformer 448 at the gate of the flash tube 402 and emits a flash of light during the discharge of the high voltage capacitor 406 in response to a flash trigger signal provided by the detector circuit 412.

The detector circuit 412 comprises an emitter-detector pair 452, a switching amplifier 454, and a RC network 456. The emitter-detector pair 452 is comprised of a light emitting diode 458 and the photo transistor 460. The anode of the diode 458 is connected to the positive side of the low voltage power source 404. A current limiting resistor 462 couples the cathode of the diode 458 to the negative side of the power source 404 through the switch 424. The open base of the photo transistor 460 is arranged to detect light emitted from the diode 458. A resistor 464 is connected to the emitter of the photo transistor 460. A coupling capacitor 466 has one terminal connected to the junction of the emitter of the photo transistor 460 and the emitter resistor 464, and the other terminal is connected to the base of the switching amplifier 454. A pull up resistor 468 is connected at the junction of the coupling capacitor 466 and the base of the switching amplifier 454. A resistor 470 is connected to the collector of the switching amplifier 454, and a coupling capacitor 472 has one terminal connected to the junction of the collector of the switching amplifier 454 and the collector resistor 470, the other terminal of which is connected to the gate of the discharge SCR 442. A pull down resistor 474 is connected at the junction of the coupling capacitor 472 and the gate of the discharge trigger SCR 442. The coupling capacitor 472 and the pull down resistor 474 form an RC network which provides a desired time delay for reaching the gate voltage of the discharge trigger SCR 442. Since a phosphorescent ball 200 (shown in FIG. 2 above) travels at a rate of 80 to 100 meters (m) per second leaving the muzzle 110, a delay of 0.1 to 0.15 milliseconds (ms) is required before the trigger circuit 410 sets off the flash tubes 402. A Zener diode 476 connected to the collector of the photo transistor 460 regulates the voltage across the photo transistor 460, switching amplifier 454, and the gate of the discharge trigger SCR 442 to 9 VDC, and a resistor 478 connecting the collector resistor 470 of the switching amplifier 454 and the anode resistor 440 of the discharge trigger SCR 442 is a voltage control resistor for the low voltage supply 404.

As shown in FIGS. 9 through 12, and further referring to FIG. 8, in operation, the exciter 300 is coupled to the muzzle 110 of a paintball gun. The exciter 300 is energized by closing the switch 424. Upon closing the switch 424, the infrared light emitting diode 458 emits an infrared beam across the tube 358 passing through the exciter housing 310. The presence of the infrared beam is detected by the photo transistor 460, as is shown in FIG. 10. As a phosphorescent ball 200 is discharged from the paintball gun 100, it enters the tube 358 passing through the housing 310 of the exciter 300. As the phosphorescent ball 200 passes between the diode 458 and the photo transistor 460, the infrared beam emitted from the infrared diode 458 is interrupted, as is shown in FIG. 11. The interruption in the infrared beam is detected by the photo transistor 460, which produces a pulse at its output. The output of the photo transistor 460 is amplified by the switching amplifier 454. The output of the switching amplifier 454 triggers the discharge trigger SCR 442. The RC network 456 provides a desired time delay for triggering the discharge trigger SCR 442 to compensate for the travel of the phosphorescent ball 200 and the distance between the flash tubes 402 and the emitter-detector pair 452. When the discharge trigger SCR 442 is triggered, the high voltage capacitor 406 discharges through the trigger transformer 448, stepping up the 250 VDC stored therein to produce a 3000 VDC signal at the electrode of the flash tube 402, causing the flash tube 402 to flash an ultra violet rich light, as shown in FIG. 12. When the flash lamp 402 flashes, the phosphorescent ball 200 is excited, that is, the phosphorescent material in the phosphorescent ball 200 absorbs the light emitted from the flash tube 402. Subsequent to this exposure, the phosphorescent ball 200 continues to emit light, providing a luminous trail.

Figure 7:
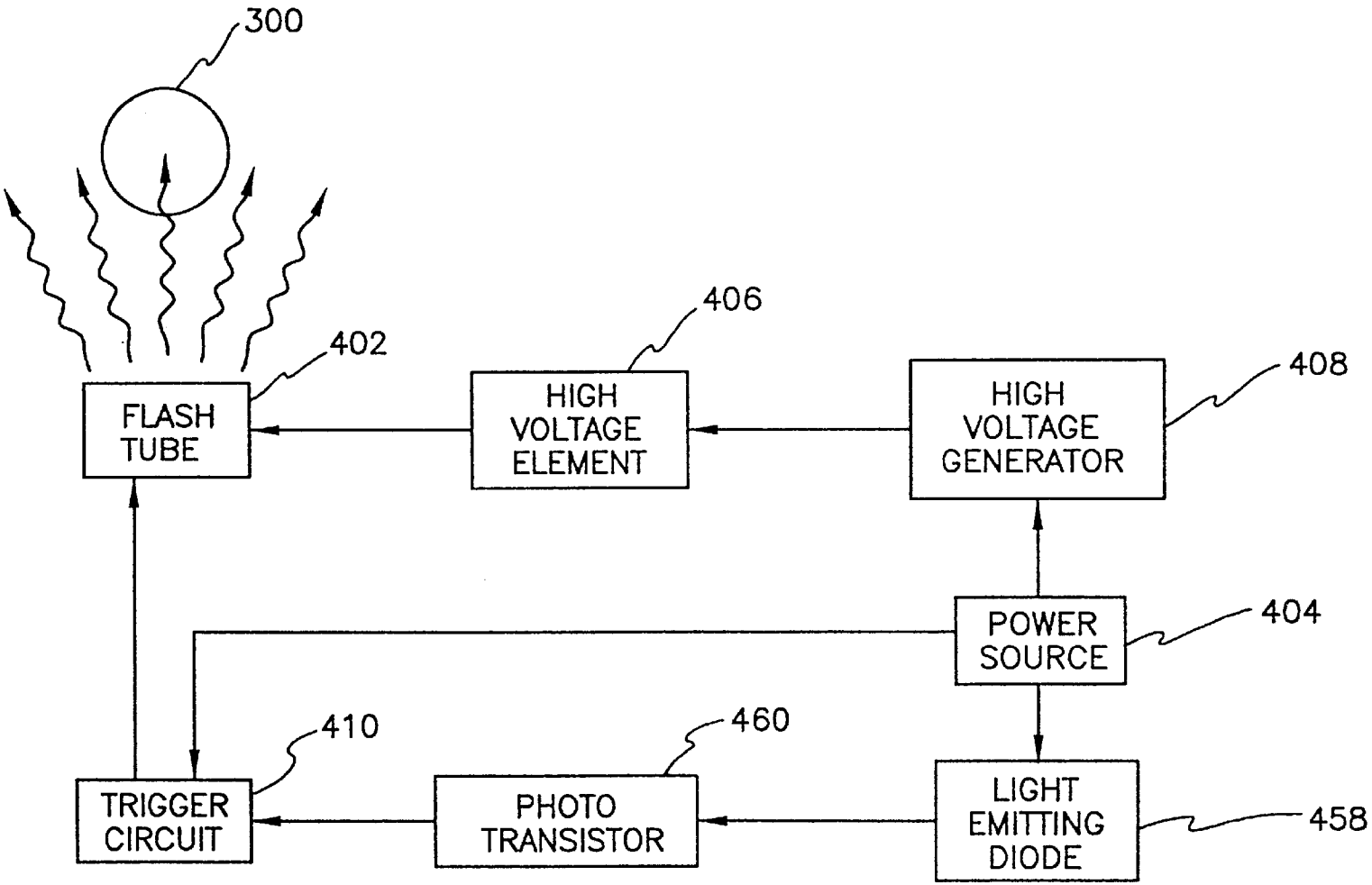
FIG. 7 is a diagrammatic representation of an exciter electrical circuit.
Figure 13:
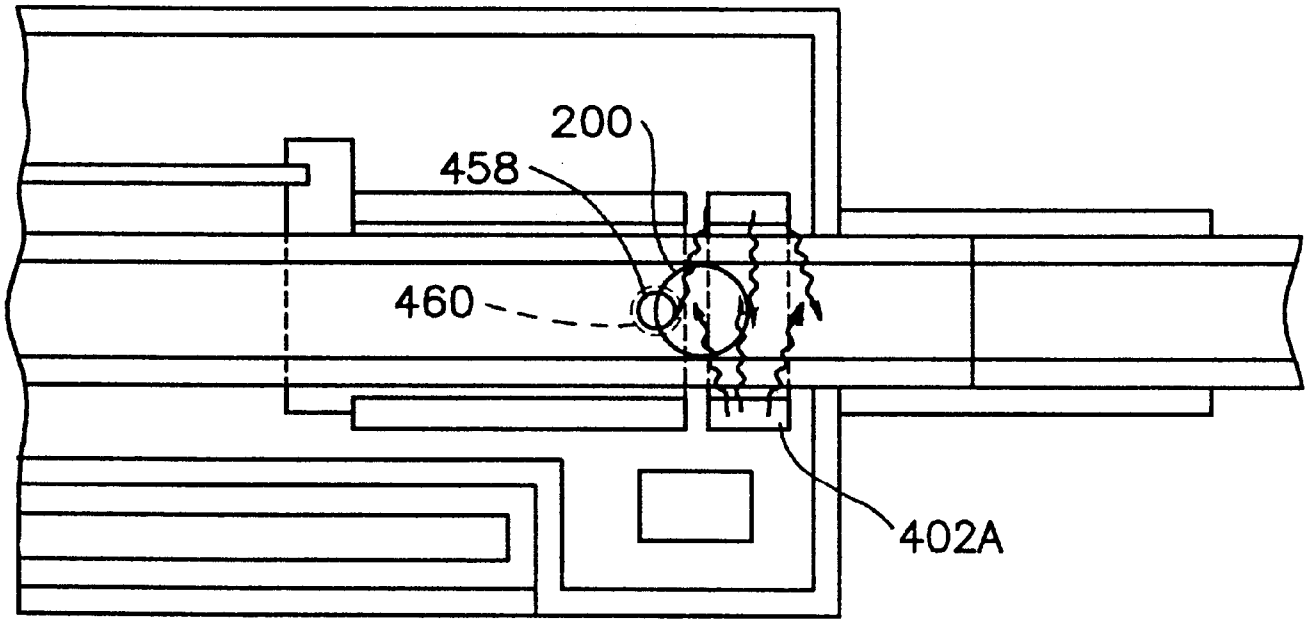
FIG. 13 is a diagrammatic representation of an alternative exciter employing a lash ring leading the emitter-detector pair.

FIG. 13 shows an alternative arrangement wherein a flash ring 402A is employed. The flash ring 402A leads the diode 458 and the photo transistor 460. As the leading edge of a phosphorescent ball 200 being discharged interrupts the signal from the light emitting diode 458, the trigger circuit 410 (shown in FIGS. 7 and 8) triggers the flash ring 402A to emit a flash of ultraviolet rich light which is absorbed by the phosphorescent material in the phosphorescent ball 200. Although a flash ring 402A may irradiate the phosphorescent ball with more light, it may be more costly than a conventional flash tube 402. It should be noted that the arrangement of either the flash tube 402, a plurality of flash tubes 402, or the flash ring 402A may lead or lag the emitter-detector pair 452, and may be arranged adjacent to one another or may be spaced apart.

Figure 18:
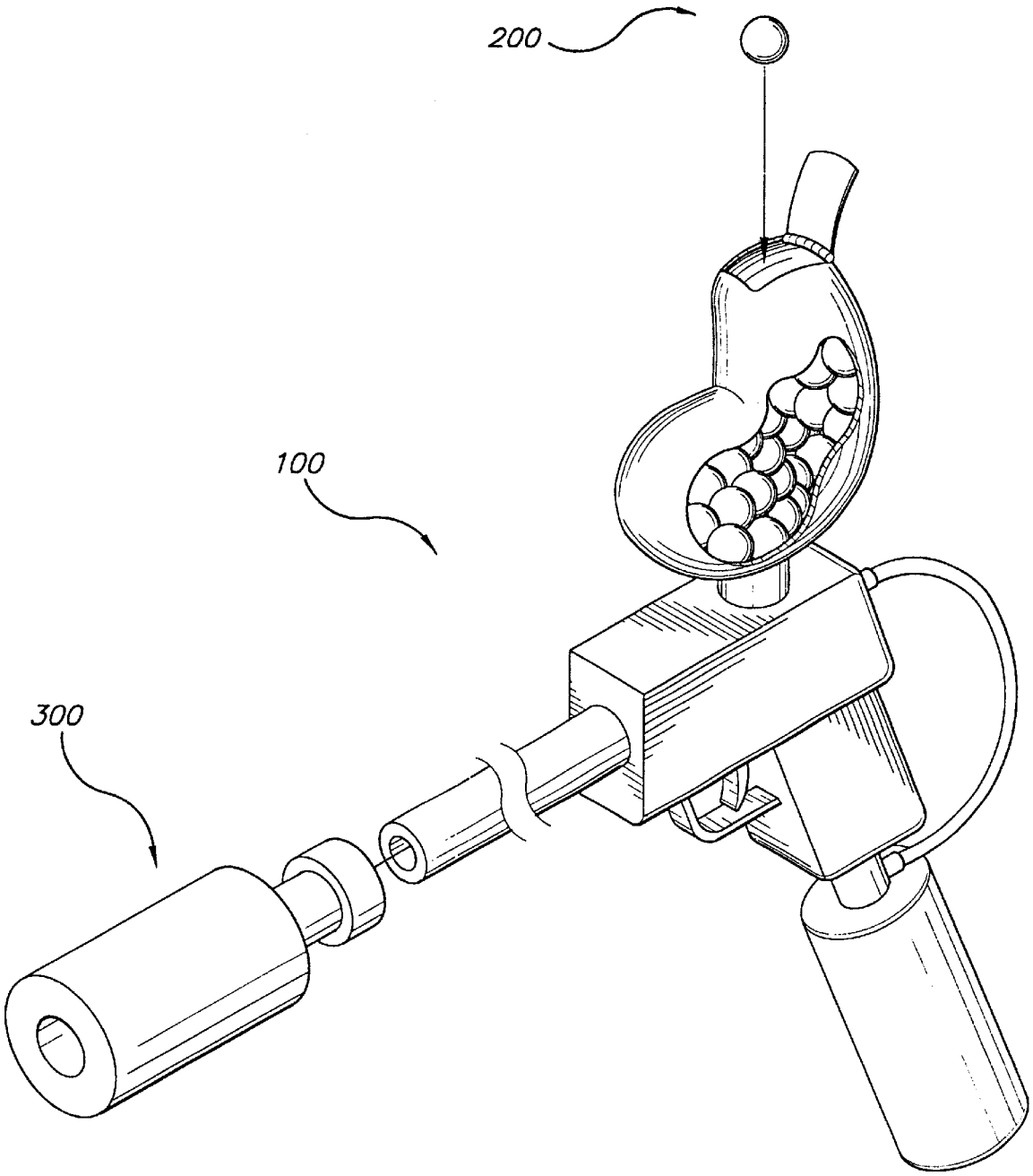
FIG. 18 is a partial section view of another phosphorescent ball according to the instant invention.

A paintball gun 100 may also be provided in combination with the exciter 300 and phosphorescent balls 200 to in a kit, thereby providing a complete system as shown in FIG. 18. In such a system, the exciter 300 may be sized to fit the muzzle 110 without need for additional adapters, though such adapters may be provided separately so that the kit may be used with other paintball guns. Further, the gun 100 and exciter 300 may be integrated together.

It is to be further understood that the present invention is not limited to the embodiments described above, but encompasses any and all embodiments within the scope of the following claims.

What is claimed is:

1. A paintball comprising:

a shell defining an interior chamber;

a filler contained within the interior chamber; and a phosphorescent material mixed in said filler.

2. A paintball according to claim 1, wherein said phosphorescent material comprises a basic material and an activator.

3. A paintball according to claim 2, wherein said basic material is zinc sulfide and said activator is copper.

4. A paintball according to claim 2, wherein said basic material is selected from a group consisting of zinc, sulfide, calcium, and strontium, and said activator is selected from a group consisting of copper, manganese, and bismuth.

5. A paintball according to claim 1, wherein said phosphorescent material is suspended in said filler by a surfactant.

6. A paintball according to claim 5, wherein said surfactant is selected from a group consisting of oxazoline-type nonvolatile surface active agents; fatty alcohol phosphates; polyoxyethylene-sorbitane-monolaurate; and polyoxyethylene-sorbitane-monooleate.

7. The paintball according to claim 5, wherein the weight ratio of said surfactant to said phosphorescent material is about 6:4.

8. A painthall according to claim 1, wherein said filler is selected from a group consisting of glycerin and glycol.

9. A paintball according to claim 1, wherein said shell comprises gelatin.

10. A paintball according to claim 1, wherein said shell is impregnated with said phosphorescent material.

11. A paintball comprising:

a gelatin shell defining an interior chamber;

a filler contained within the interior chamber, said filler being selected from a group consisting of glycerin and glycol; and a phosphorescent material suspended in said filler by a surfactant, said phosphorescent material comprising a basic material and an activator.

12. The paintball according to claim 11, wherein said basic material is zinc sulfide and said activator is copper.

13. A paintball according to claim 11, wherein said basic material is selected from a group consisting of zinc, sulfide, calcium, and strontium, and said activator is selected from a group consisting of copper, manganese, and bismuth.

14. A paintball according to claim 11, wherein said surfactant is selected from a group consisting of oxazoline-type nonvolatile surface active agents; fatty alcohol phosphates; polyoxyethylene-sorbitane-monolaurate; and polyoxyethylene-sorbitane-monooleate.

15. The paintball according to claim 11, wherein the weight ratio of said surfactant to said phosphorescent material is about 6:4.

16. A paintball according to claim 11, wherein said shell is impregnated with said phosphorescent material.

17. A phosphorescent ball used as projectile ammunition for an air-powered gun, said phosphorescent ball comprising:

an impact energy dispersing pellet formed of one or more non-phosphorescent, light transmissive pellet materials, said pellet having a substantially spherical exterior periphery; and phosphorescent material supported by said pellet by intimate incorporation of said phosphorescent material into at least one of said non-phosphorescent, light transmissive pellet materials of said pellet.

18. A phosphorescent ball according to claim 17, wherein said phosphorescent material comprises a basic material and an activator.

19. A phosphorescent ball according to claim 18, wherein said basic material is selected from a group consisting of zinc sulfide, calcium sulfide, and strontium sulfide, and said activator is selected from a group consisting of copper, manganese, and bismuth.

20. A phosphorescent ball according to claim 17, wherein said pellet includes:

a fracturable shell defining an interior chamber; and a filler contained within the interior chamber.

21. A phosphorescent ball according to claim 20, wherein said pellet further comprises a surfactant, said phosphorescent material being suspended in said filler by said surfactant.

22. A phosphorescent ball according to claim 21, wherein said surfactant is selected from a group consisting of: oxazoline-type nonvolatile surface active agents; fatty alcohol phosphates; polyoxyethylene-sorbitane-monolaurate; and polyoxyethylene-sorbitane-monooleate.

23. A phosphorescent ball according to claim 20, wherein said filler is selected from a group consisting of glycerin and glycol.

24. A phosphorescent ball according to claim 20, wherein said fracturable shell comprises gelatin.

25. A phosphorescent ball according to claim 20, wherein said fracturable shell is impregnated with said phosphorescent material.

26. A phosphorescent ball according to claim 17, wherein said pellet further comprises one or more non-phosphorescent pigment materials.

27. A phosphorescent ball according to claim 17, wherein said pellet material is a resilient pellet material.

28. A phosphorescent ball according to claim 17, wherein said resilient pellet material is a solid polymeric material selected from the group consisting of urethane polymers and silicone rubbers.

29. A phosphorescent ball according to claim 17, wherein said resilient pellet material is a cellular foam material.

30. A phosphorescent ball according to claim 17, wherein said phosphorescent material is provided in an amount from about 0.5 percent to about 1.5 percent by weight of the total phosphorescent ball.

31. A paintball gun for discharging phosphorescent balls, said paintball gun having an exciter coupled thereto, said exciter being adapted to excite a phosphorescent ball so that the phosphorescent ball emits light and provides a luminous trail when discharged from said paintball gun.

32. A paintball gun according to claim 31, further including a muzzle, said exciter being coupled to said muzzle.

* * * * *